US009288592B2

(12) United States Patent
Basseas

(10) Patent No.: US 9,288,592 B2
(45) Date of Patent: Mar. 15, 2016

(54) CUSTOM EAR ADAPTOR SYSTEM WITH BALLOON-STYLE OR ELASTOMERIC DOME EARPIECE

(71) Applicant: CONVERSION SOUND INC., Park Ridge, IL (US)

(72) Inventor: Stavros Basseas, Park Ridge, IL (US)

(73) Assignee: CONVERSION SOUND INC., Park Ridge, IL (US)

( * ) Notice: Subject to any disclaimer, the term of this patent is extended or adjusted under 35 U.S.C. 154(b) by 0 days.

(21) Appl. No.: 13/752,826

(22) Filed: Jan. 29, 2013

(65) Prior Publication Data

US 2013/0202141 A1 Aug. 8, 2013

Related U.S. Application Data

(60) Provisional application No. 61/594,126, filed on Feb. 2, 2012.

(51) Int. Cl.
*H04R 25/00* (2006.01)
*H04R 1/10* (2006.01)

(52) U.S. Cl.
CPC ..... *H04R 25/652* (2013.01); *H04R 1/1016* (2013.01); *H04R 25/656* (2013.01); *H04R 2460/11* (2013.01)

(58) Field of Classification Search
CPC .... H04R 25/60; H04R 25/602; H04R 25/604; H04R 25/606; H04R 25/608; H04R 25/65; H04R 25/652; H04R 25/654; H04R 25/656; H04R 25/658
USPC ..... 381/380, 322–331
See application file for complete search history.

(56) References Cited

U.S. PATENT DOCUMENTS

| | | | | |
|---|---|---|---|---|
| 3,602,654 | A | 8/1971 | Victoreen | |
| 4,006,796 | A | 2/1977 | Coehorst | |
| 4,776,322 | A * | 10/1988 | Hough et al. | 381/326 |
| 5,208,867 | A * | 5/1993 | Stites, III | 381/361 |
| 6,339,648 | B1 * | 1/2002 | McIntosh et al. | 381/328 |
| 7,418,105 | B2 | 8/2008 | McIntosh | |
| 2003/0070868 | A1 * | 4/2003 | Kolpe et al. | 181/135 |

(Continued)

FOREIGN PATENT DOCUMENTS

| | | | |
|---|---|---|---|
| WO | WO 00/47016 | A1 | 8/2000 |
| WO | WO 2009/015210 | A2 | 1/2009 |

(Continued)

OTHER PUBLICATIONS

Search Report for corresponding EP application 13153225.1 dated May 2, 2013.

(Continued)

*Primary Examiner* — Ahmad F Matar
*Assistant Examiner* — Katherine Faley
(74) *Attorney, Agent, or Firm* — Husch Blackwell LLP

(57) ABSTRACT

An earpiece system for adapting an electronic sound producing module to an elastomeric earpiece device. The earpiece system includes an elastomeric base that mechanically snaps together with the electronic sound producing module, and a vibration dampening tube that prevents sound feedback of the overall amplification unit while also interfacing with one of a selection of elastomeric devices that fit in the ear, or a custom molded in-the-ear housing.

17 Claims, 6 Drawing Sheets

(56) References Cited

U.S. PATENT DOCUMENTS

| | | | | |
|---|---|---|---|---|
| 2003/0081805 | A1* | 5/2003 | Fushimi | 381/325 |
| 2003/0165248 | A1* | 9/2003 | Lenz et al. | 381/312 |
| 2004/0264723 | A1 | 12/2004 | Saltykov | |
| 2007/0201717 | A1 | 8/2007 | Dyer et al. | |
| 2007/0206826 | A1* | 9/2007 | Rohrlein | 381/325 |
| 2008/0031481 | A1* | 2/2008 | Warren et al. | 381/322 |
| 2008/0232628 | A1* | 9/2008 | Ho et al. | 381/330 |
| 2011/0194716 | A1* | 8/2011 | Gommel et al. | 381/328 |
| 2011/0280425 | A1 | 11/2011 | Gibbons | |

FOREIGN PATENT DOCUMENTS

| | | | |
|---|---|---|---|
| WO | WO 2009/115618 | A2 | 9/2009 |
| WO | WO 2012/007193 | A1 | 1/2012 |

OTHER PUBLICATIONS

Communication pursuant to Article 94(3) EPC for corresponding European Application No. 13 153 225.1-1910 dated Nov. 3, 2014.

* cited by examiner

Section A-A or B-B

Section C-C or D-D

Section B-B

Section B-B

Section A-A

CUSTOM EAR ADAPTOR SYSTEM WITH BALLOON-STYLE OR ELASTOMERIC DOME EARPIECE

CROSS-REFERENCE TO RELATED APPLICATION

This application claims the benefit of the filing date of U.S. Provisional Application Ser. No. 61/594,126 filed Feb. 2, 2012, entitled, "Custom Ear Adaptor System". The '126 application is hereby incorporated herein by reference.

FIELD

The application pertains to systems and methods of creating customized ear adaptors for personal amplification systems and any ear level sound amplification system that includes a microphone and is susceptible to feedback problems. More particularly, the application pertains to such systems and methods which provide an earpiece system for adapting an electronic sound producing module to an elastomeric earpiece.

BACKGROUND

A variety of sound amplifying systems are known to improve the listening ability of individuals with different hearing deficiencies and preferences. Some of these provide shapes customized to match the shape of the intended recipient's ear canal.

Many sound producing devices require that the sound output be placed in or close to the ear. When inside the ear two conditions are required 1) that the device provides a good acoustic seal and reduced vibration which is important for device performance and sound quality, and 2) that the device fits comfortably in the ear. Existing methods take many forms including the use of ear domes or ear tips that fit inside the ear and connect to an electronic device or inflated or infused membranes/balloons or sheaths that are filled while inside the ear to capture and create a custom shape which then connects to an electronic device.

Custom shaped ear pieces are regularly used throughout industries that include ear plug production, hearing protection, hearing aid manufacture, assisted listening device manufacture, and headphone products. One such existing process for creating a custom ear piece is to insert a balloon or sheath into the ear, and while it is in the ear the balloon is filled. Known approaches share the concept of a deflated membrane inserted into the ear and then filled with a substance that conforms to the surface of the inner and outer ear. However that is the extent of the concept limiting the choice of fitting systems to the filled balloon.

Another method of adapting sound producing devices to the ear is through the use of pre molded ear domes or ear tips that fit inside the ear and connect to an electronic device. This concept is common to everything from hearing aids to off-the-shelf earplugs, to common mp3 ear buds.

In these existing designs the domes and filled membrane are designed to provide three functions: 1) as the ear surface interface 2) as the sound bore for transmitting sound into the ear, and 3) as the air vent to allow air passage into and out of the ear. One disadvantage of these approaches is that the material used is not sound dampening and therefore transmits acoustic energy out of the ear potentially causing acoustic feedback and limiting the gain (amplification) of the instrument. Another is that the venting is nonexistent in the case of the filled membrane.

While the above noted products and methods can improve the amplification needs and preferences of various users, there continues to be a need for improved systems and methods which are flexible as well as comfortable with reduced feedback and easy to use.

DETAILED DESCRIPTION

Figure 1:
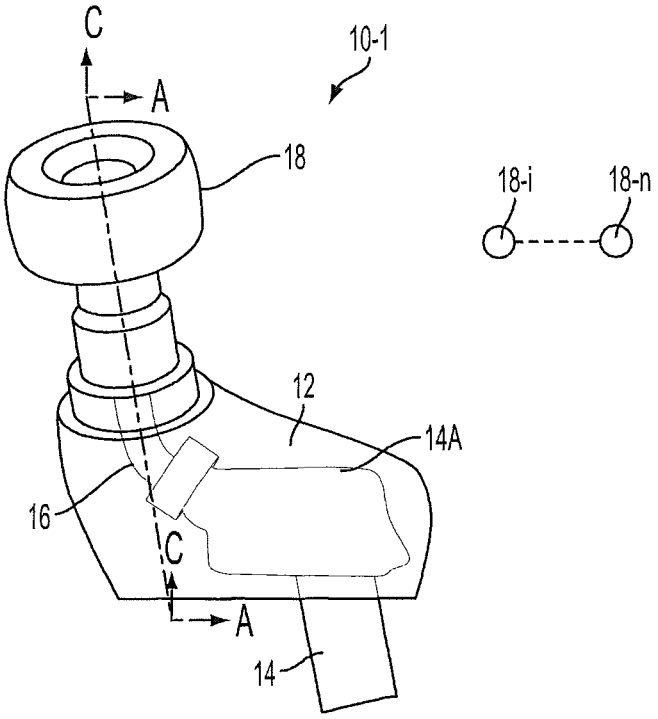
FIG. 1 illustrates the sound producing section of an amplification unit with a dome style ear tip in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

Embodiments hereof incorporate a base unit which provides a choice between using stock ear tips/domes and a custom fitted mold to create an adequate acoustic seal in the ear while providing the advantages of comfort and simplicity. Problems associated with gain limitations and venting are solved herein by a novel and non-obvious venting system and novel and non-obvious acoustic dampening sound bore that work with either an in-the-ear structure or any electronic sound producing module that fits into the base unit.

Disclosed embodiments include a base unit; an inner acoustic dampening sound bore sleeve and one of interchangeable domes of varying size or an inflatable membrane that can be filled after placement in the inner ear.

The base unit serves two functions: 1) acts as the mechanical and acoustical connector for the electronic sound producing module and the ear canal, and 2) connects the electronic sound producing module to the domes and membrane that fit into the ear canal.

The base unit is formed of an elastomer, biocompatible material such as silicone or urethane. Other elastomers come within the spirit and scope of the invention.

The connection to the electronic sound producing module relies on a snap fit made possible by the elastic behavior of the material. The material can be stretched to insert the larger electronic sound producing module through an undersized opening until the electronic sound producing module seats firmly into a cavity. The fit of the material around that module is tight enough to provide an acoustic seal.

Additionally, the base unit is equipped with an air vent channel that allows the passage of air into and out of the inner ear no matter which in-ear system is chosen.

Those of skill will know that various forms of electronic sound producing modules are known for use with sound producing devices. A variety of such modules come within the spirit and scope of the present invention. The specific details of such modules are not limitations of the present invention, except to the extent discussed herein.

It is important to note that all acoustic systems produce vibration. This vibration can limit the performance, particularly the gain, of any sound producing device by causing feedback through acoustic coupling to the microphone. To prevent feedback, special sound dampening materials are used that reduce/limit/eliminate the transmission of vibrations. Typically these sound dampening materials are not biocompatible in regard to skin contact.

Therefore, included with the base unit is a sound dampening sound bore tube which fits into the base unit creating a tight seal around the sound port of the electronic sound producing module. The sound dampening sound tube then extends out of the base unit and into the inner ear; however, it remains surrounded by the biocompatible silicone molds/tulips. This means that the sound bore is a separate piece from the base unit which prevents earpiece vibrations to the outer world.

Prevention of vibration, as noted above, allows for higher gain (amplification) levels in the instrument than would be possible with a single piece earpiece system of a single non dampening material. The vibration dampening sound bore is present no matter which of the in-ear systems are chosen.

The vibration dampening tube material is not biocompatible and, therefore, cannot be used for skin contact. So a unique feature of this design is the inclusion of the sound dampening tube that prevents vibration transmission, but also prevents the sound dampening tube from contacting the skin by always enclosing it within the biocompatible in-ear materials.

The in-ear systems include a series of pre-molded elastomeric domes/tips or a balloon that is infused with material after the balloon is inserted into the ear cavity.

The series of pre-molded elastomeric domes/tips includes a plurality of thin walled tulip shape items. Each tip has a lower portion that is designed to interface with the base unit through an adhesive connection. The interface between the tip and the base allows the sound bore unit to proceed into the ear canal and deliver sound to the ear. The interface also allows the vent channel access to the inner ear which allows air passage. Air passage is important to maintain comfort in the ear, provide better sound quality and reduce occlusion.

The upper half of the elastomeric tip creates the acoustic seal between the end of the sound bore and the outside of the ear. The tip is designed to create as little pressure on the inner ear while still maintaining an adequate acoustic seal. To provide for the same level of comfort in a variety of ear shapes and sizes the tips are made in four different multiple sizes.

The infused balloon embodiment includes a thin silicone membrane that is designed to interface with the base unit through an adhesive connection. The adhesive connections create an air tight seal between the inner cavity of the balloon and the outer space.

Once the balloon is placed in the ear a syringe is used to pierce the base unit and gain access to the interior cavity of the balloon. The syringe is then used to withdraw any air that is trapped inside the balloon. When the syringe is withdrawn the natural elastic properties of the pierced base unit closes off the passage into balloon cavity thereby sealing the balloon cavity and preventing air from re-entering the interior.

Once the balloon cavity has been evacuated the balloon/base assembly is placed in the ear with the collapsed balloon portion extending into the ear canal. An injector attached to a material dispensing cartridge is then inserted through the same passage way as during the evacuation step. Material is infused into the interior of the balloon expanding the balloon until it comes in contact with the walls of the ear canal. Once the material has solidified the custom piece can be removed from the ear and re-inserted multiple times.

The system shown in the drawings includes a dome style unit, 10-1 and a balloon style version 10-2. A base unit 12 made from an elastomeric material acts as the interface between the other components.

FIG. 1 illustrates a complete assembled unit 10-1 with a dome style ear tip. The included parts are the base unit 12, shown as a transparency, the electronic sound producing module 14 and module cavity 14A, the incorporated vibration dampening tube 16, and a tulip dome style earpiece 18. It will be understood that the tulip dome earpiece 18 could be selected from a plurality of dome earpieces of different sizes, 18-*i* . . . 18-*n*, so as to be compatible with the ear of a user.

Figure 1A:
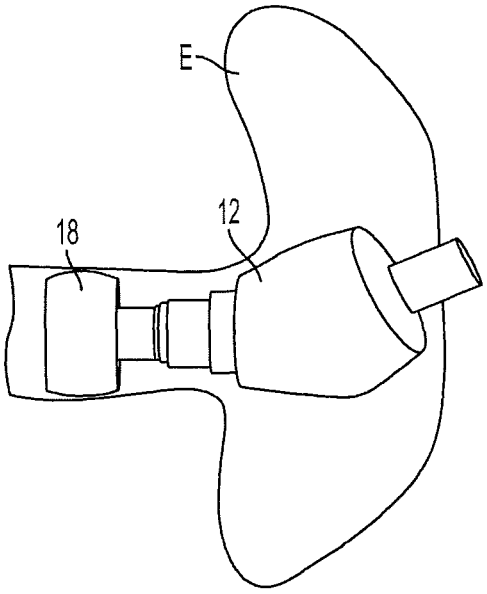
FIG. 1A illustrates the unit of FIG. 1 inserted in an ear canal.

FIG. 1A illustrates the complete unit 10-1 with Dome 18 inserted into the ear canal of a user's ear E.

Figure 2:
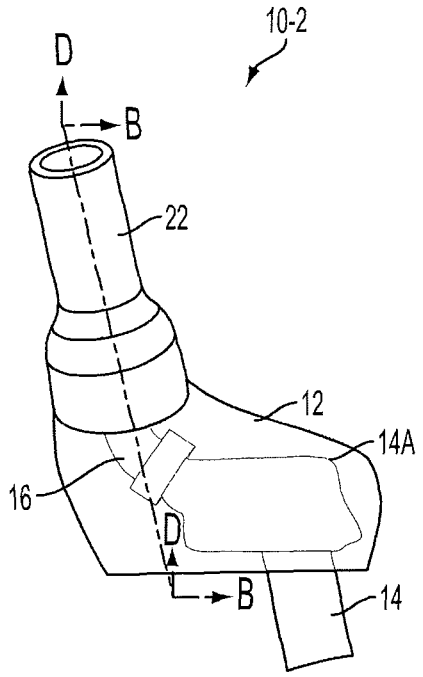
FIG. 2 illustrates the sound producing section of an amplification unit with a balloon style ear tip in accordance herewith.

FIG. 2 illustrates a complete assembled unit 10-2 with a balloon style ear tip 22. The included parts are the base unit 12, shown as a transparency, the electronic sound producing module 14 and module cavity 14A, the incorporated vibration dampening tube 16, and a balloon style earpiece 22.

Figure 2A:
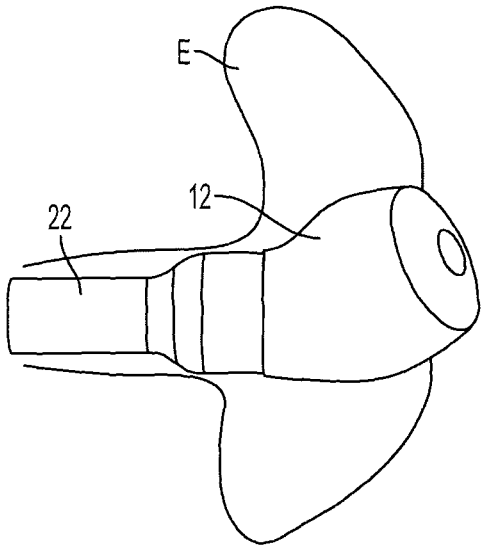
FIG. 2A illustrates the unit of FIG. 2 inserted in an ear canal.

FIG. 2A illustrates the complete unit 10-2 with balloon 22 inserted into the ear canal of the user's ear E.

Figure 3:
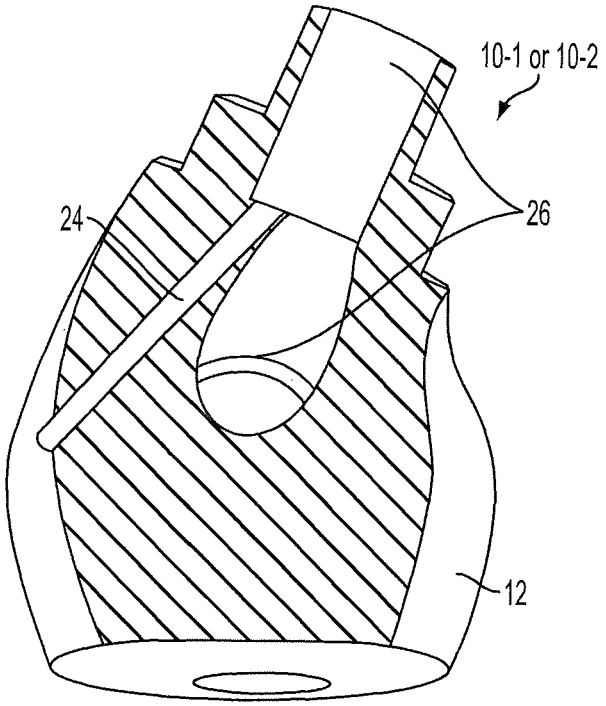
FIG. 3 illustrates a cross section, along plane A-A, of a base unit as in FIG. 1 or along plane B-B, of a base unit as in FIG. 2.

FIG. 3, a section taken along plane A-A, of FIG. 1 or a section taken along plane B-B of FIG. 2, illustrates a cross section of the base unit 12. This figure includes features of the base unit 12 such as the vent channel 24 and the sound bore area 26.

Figure 4:
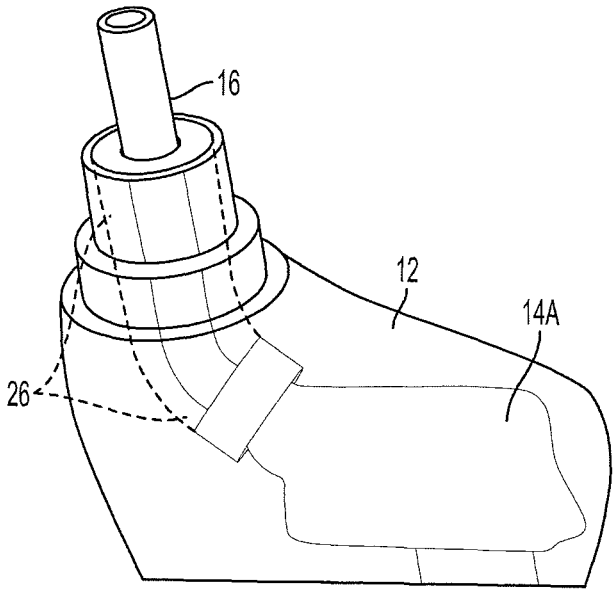
FIG. 4 illustrates a transparent view of the base unit of FIG. 1 or FIG. 2.

FIG. 4 illustrates a transparency of the base unit 12 and the incorporated vibration dampening tube 16 which is placed in the base unit 12 through the sound bore area 26.

Figure 5:
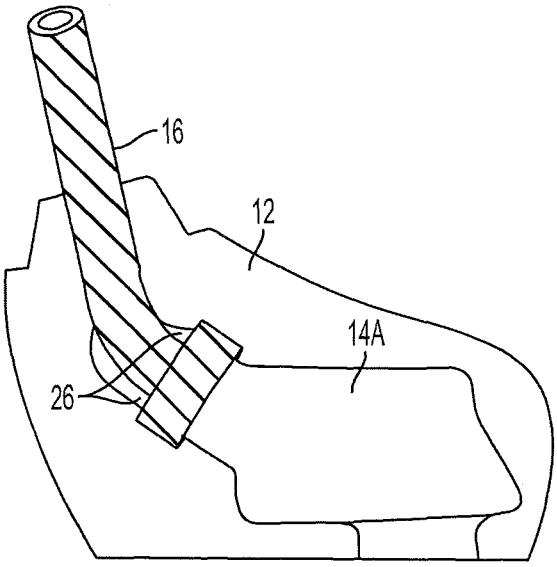
FIG. 5 illustrates a cut section view along plane C-C of FIG. 1 or along plane D-D of FIG. 2 of another embodiment of the base unit 12.

FIG. 5 illustrates a cut section view along plane C-C of FIG. 1 or along plane D-D of FIG. 2 of another embodiment of the base unit 12, through the electronic module cavity 14A and the sound bore area 26 which shows the incorporated vibration dampening tube 16 in place.

Figure 6:
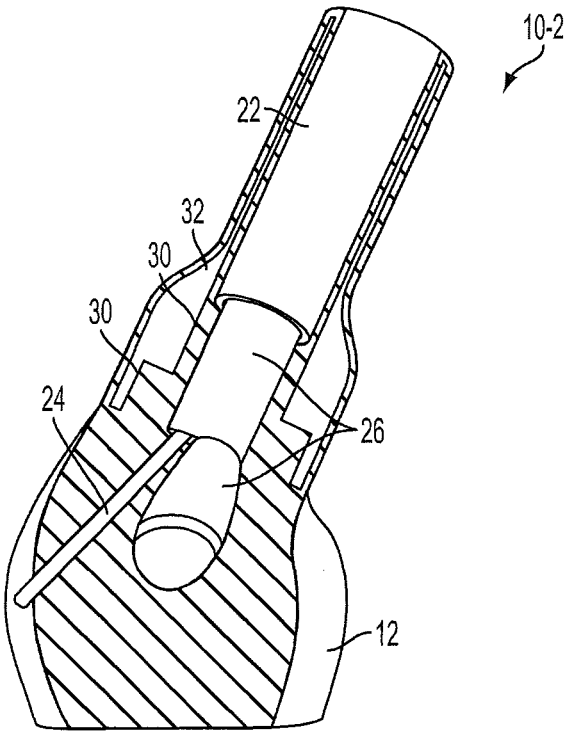
FIG. 6 illustrates a cross section along plane B-B of the base unit of FIG. 2 through the vent channel.

FIG. 6 illustrates a cross section taken along plane B-B of FIG. 2 of the base unit 12, through the vent channel 24, the sound bore area 26, and the balloon ear piece 22. This reveals the adhesive areas which attach the balloon earpiece 22 to the base unit 12 using silicone adhesive 30.

Figure 7:
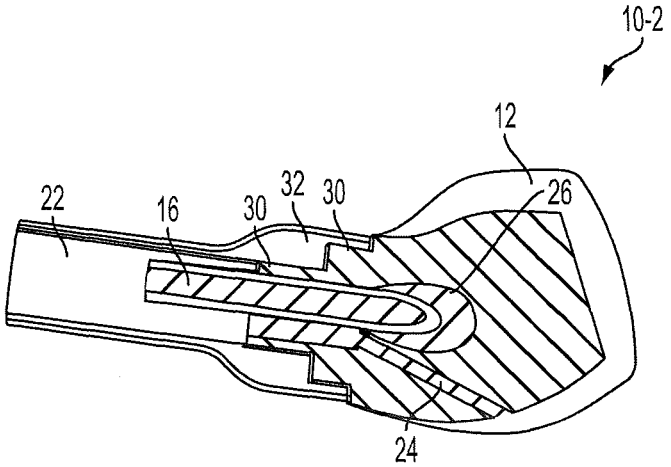
FIG. 7, section B-B, illustrates additional details of the base unit of FIG. 2.

FIG. 7 illustrates a cross section taken along plane B-B of FIG. 2 of the base unit 12, through the vent channel 24, the sound bore area 26, and the balloon ear piece 22. This reveals the adhesive areas which attach the balloon earpiece 22 to the base unit 12 using the silicone adhesive 30. It also reveals the vibration dampening tube 16 in place within the base unit 12 and sound bore area 26, as well as the balloon interior 32.

Figure 8:
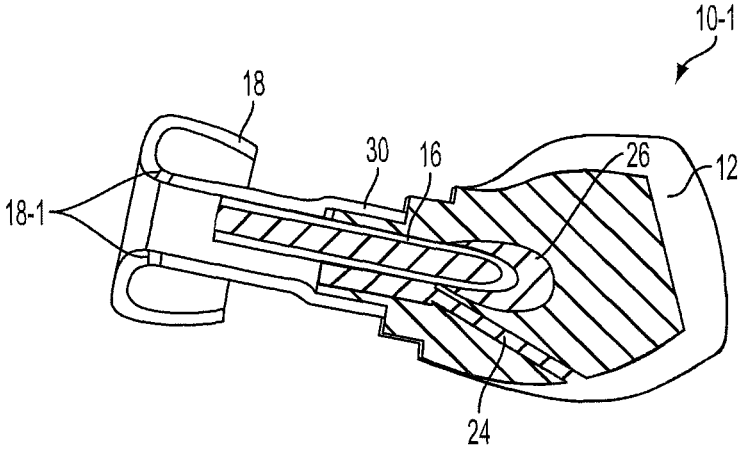
FIG. 8, section A-A, illustrates other details of the base unit of FIG. 1.

FIG. 8 illustrates a cross section taken along plane A-A of FIG. 1 of the base unit 12, through the vent channel 24, the sound bore area 26, and the dome ear piece 18. This reveals the adhesive areas which attach the dome earpiece 18 to the base unit 12 using silicone adhesive 30. It also reveals the vibration dampening tube 16 in place within the base unit 12 and sound bore area 26.

Figure 9:
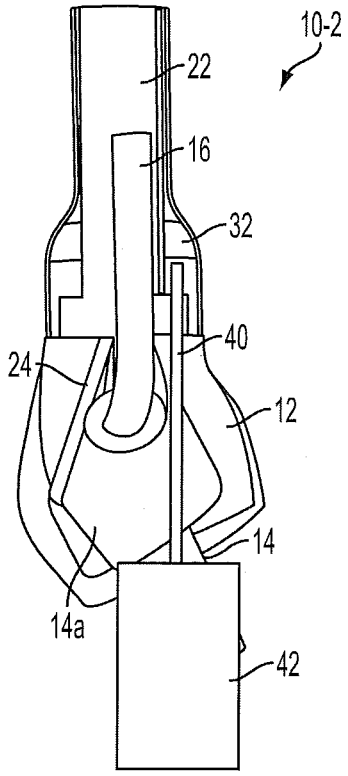
FIG. 9 illustrates an evacuated balloon prior to material infusion.

FIG. 9 illustrates the evacuated balloon 22 prior to material infusion with an injector 40 inserted into the balloon interior 32.

Figure 10:
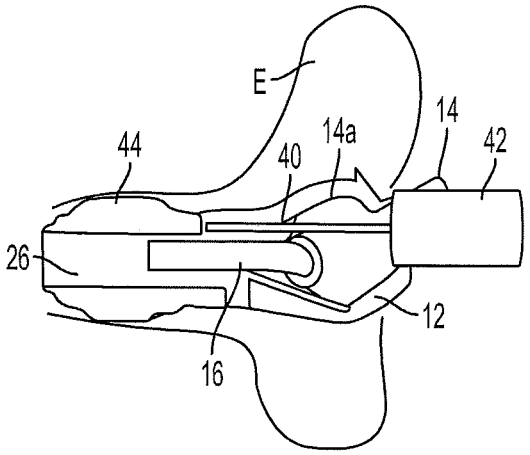
FIG. 10 illustrates an infusion injector coupled to the balloon of FIG. 9 for infusing material into and expanding the balloon.

FIG. 10 illustrates the injector 40 attached to a material dispensing cartridge 42 inserted through the same passage way created during the evacuation step. Material 44 is infused into the interior 32 of the balloon 22 expanding the balloon 22 until it comes into contact with the walls of the ear canal of the user's ear E. Once the material has solidified the custom piece can be removed from the ear E and re-inserted multiple times.

An electronic sound producing module 14 made from hard non-elastic plastic is inserted in the module cavity 14A in the base unit 12 using a sufficient force to stretch the elastic base material enough to permit the electronics sound producing module 14 to snap into place and remain in place until another sufficient force is used to remove it from the base unit 12. The retention force of the base unit 12 around the electronic sound producing module 14 is enough to provide an acoustic seal and prevent sound from leaking around the module 14 during use.

The base unit 12 also has a passage that extends from the electronic sound producing module 14 and cavity 14A, through the base unit 12 and into the area where the selectable ear tips, for example, the dome 18 or balloon 22, are located. This passage serves as the housing for the vibration dampening tube 16.

The vibration dampening tube 16 creates an acoustically sealed passage that extends from the sound output port of the electronic sound producing module 14 through the sound bore area 26 of base unit 12 and into the area of the ear tips, such as 18, or 22. As a result, the vibration dampening tube 16 acoustically seals the acoustic path of the sound traveling between the module 14 and the ear canal of the user's ear E. Hence, the transmission of vibration is minimized, which prevents sound escaping from the unit and reaching the microphone of the module 14, therefore, reducing acoustic coupling or feedback.

The base unit 12 also contains the vent channel 24 to allow the passage of air into and out of the user's ear canal. This has two purposes, 1) for the comfort of the user an air channel is necessary to reduce occlusion in the ear resulting in a barrel effect, or low frequency signal distortion in the user's ear. The vent channel 24 also allows the passage of low frequency signals to pass into the ear canal of the user's ear E without going through the module 14. This also improves the sound quality for the user. However, if for reasons associated with the needs and preferences of the user, the vent channel 24 can be blocked. Alternately, as in FIG. 8, embodiment 10-1 can include holes or openings 18-1, near the sound bore tip of dome 18 to provide venting for user comfort. Further, as would be understood by those of skill in the art, an optional dampening lining can be provided for the vent and or the sound bore area of the dome 18 to minimize vibrations.

The ear tip dome 18 is attached to the base unit 12 through the use of elastomeric adhesive 30 compatible with both the material of the base unit 12 and the material of dome 18. The adhesive 30 is applied to the interface area as shown achieving sufficient retention force to keep the dome 18 attached to the base unit 12 during multiple insertions of the system into and removals of the system out of the ear canal of the user's ear E.

In the case of the dome 18 there are multiple sizes available to adhere to the base unit 12. The optimum selection the size of dome 18 is made by the user's need for comfort and an acoustic seal once the system is inserted into the ear canal of the user's ear E. Once a dome, such as 18, is adhered correctly to the base unit 12 the system is ready for the user to insert it into the ear canal of the user's ear E. No other assembly or preparation work is required.

In the case of the balloon 22 there are additional process steps to prepare the embodiment 10-2 for use by the user. To prepare the balloon 22 a syringe with a needle is used to puncture the base unit 12 and create access to the interior 32 of the balloon 22. The syringe is then used to withdraw air from the interior 32 of the balloon 22. As the syringe is removed from the base unit 12, elastomeric material of the base unit 12 acts as a valve that seals the interior 32 of the balloon 22 preventing air from reentering.

An injector tool 40, connected to a material reservoir, or injection cartridge 42 is now inserted through the passage way made by the syringe until the injector 40 accesses the interior 32 of the balloon 22. The balloon 22 and embodiment 10-2 are now ready for insertion into the ear canal of the user's ear E.

The system 10-2 with the balloon 22 is placed in to the ear canal of the user's ear E. The injector 40 and cartridge 42 can be used to push material from the reservoir 42 into the interior 32 of the balloon 22. As the material 44 enters the interior 32 of the balloon 22 that balloon expands to fill the adjacent ear canal of the user's ear E thereby creating a custom molded housing for the user. However, due to the design of the balloon 22 and the vibration dampening sound tube 16, the sound passage remains open to allow sound to pass through. As would be understood by those of skill in the art, the balloon 22 could be provided with a lining of vibration dampening material.

The embodiment 10-2, filled with material 44 remains in the user's ear until the material has hardened. At this time the entire structure 10-2 can be removed from the user's ear E and then reinserted multiple times.

In summary, The earpiece systems 10-1 or 10-2 accomplish four things; the first is to provide an acoustic seal between the earpiece system and the electronic sound producing module, such as module 14; the second is to provide an acoustic seal between the earpiece system and the user's ear E while achieving a comfortable fit for the user/wearer; the third is to provide a lined sound port area that reduces vibration and acoustic radiation of the respective earpiece, such as 10-1, 10-2 thereby increasing the acoustic gain of the instrument; the fourth is to accomplish the inclusion of a dampening material without adversely affecting the biocompatibility of the system.

Thus, the present Earpiece System includes an elastomeric base, such as base 12, that mechanically snaps together with the electronic sound producing module 14, and a vibration dampening tube that prevents earpiece vibration while also interfacing with a selection of elastomeric devices that fit in the ear. The selection of in ear elastomeric devices includes one of 1) a individually custom shaped piece produced using a specialized molding process, or, 2) a series of dome shaped tips of different sizes to accommodate different ear shapes and sizes of potential users, that fit in the ear, or 3) an expandable balloon tip the fits in the ear—each in-ear device is biocompatible.

Thus to respond to various needs of users, a choice can be made between using stock ear tips/domes, or, a custom fitted mold to create an adequate acoustic seal in the ear while providing the advantages of comfort and simplicity. The problems associated with gain limitations and venting are solved by the unique venting system, described above, along with the unique acoustic dampening sound bore that work with either an in-the-ear structure, or, any electronic sound producing module, such as module 14, that fits into the base unit 12. From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A custom ear adaptor system used for sound amplification and processing and made to fit in a user's ear, comprising:

a vibration dampening sound tube that provides selected levels of acoustic gain;

an air pressure vent to increase comfort and reduce occlusion;

an expandable balloon that surrounds the vibration dampening sound tube and the air pressure vent; and an elastomeric base unit that carries the vibration dampening sound tube and the balloon, wherein the balloon, responsive to a shape of a user's ear, provides a human ear fitting that is specific to that user, wherein the balloon is structured to allow the infusion of material into an interior of the balloon, wherein the material solidifies while the balloon is situated in the user's ear, to create a custom fit for the user's ear so that the custom ear adaptor system can be removed and inserted multiple times, wherein the vibration dampening sound tube is constructed of a sound dampening material that creates an acoustically sealed path for sound traveling therein, wherein the balloon comprises a biocompatible material, and wherein the balloon isolates the sound tube from physical contact with the user's ear.

2. An adaptor system as in claim 1 wherein the base unit defines a deformable cavity for a sound producing electronic module and wherein an audio output of the module is coupled to the sound tube.

3. An adaptor system as in claim 2 wherein the module is mechanically attached to the base unit with a snap fit.

4. An adaptor system as in claim 2 wherein the vibration dampening sound tube prevents feedback of sound from the module.

5. An adaptor system as in claim 4 wherein the balloon is attached to the base unit.

6. An adaptor system as in claim 2 where the balloon carries the sound tube and the module, and where the balloon contacts the user's ear canal.

7. An adaptor system as in claim 1 wherein the balloon is attached to the base unit.

8. An adaptor system as in claim 1 wherein the sound dampening material reduces acoustic energy from escaping the sound tube along the acoustically sealed path, thereby reducing vibration of the sound tube.

9. An ear adaptor system, used for sound amplification and processing and which fits in a human ear comprising:

a vibration dampening sound tube that provides selected levels of acoustic gain;

an air pressure vent to increase comfort and reduce occlusion;

an elastomeric biocompatible ear dome that surrounds the vibration dampening sound tube and the air pressure vent; and an elastomeric base unit that carries the vibration dampening sound tube and the elastomeric biocompatible ear dome, wherein the elastomeric biocompatible ear dome provides for a human ear fitting using pre-molded elements that fit comfortably in the human ear, wherein a plurality of different sizes of ear domes is available to promote comfort and performance and one member of the plurality is selected to provide a selected fitting for a user's ear, wherein the ear adaptor system can be removed and inserted multiple times, wherein the elastomeric biocompatible ear dome isolates the vibration dampening sound tube from physical contact with the user's ear, permitting the vibration dampening sound tube to comprise a non-biocompatible material, wherein the vibration dampening sound tube is constructed of a sound dampening material that creates an acoustically sealed path for sound traveling therein, wherein at least one of the elastomeric biocompatible ear dome and the air pressure vent comprises one or more linings of the sound dampening material, and wherein the elastomeric biocompatible ear dome isolates the sound dampening material from physical contact with the user's ear.

10. An adaptor system as in claim 9 wherein the selected member of the plurality slidably engages the sound tube, and is attached thereto.

11. An adaptor system as in claim 10 wherein the air pressure vent extends between an exterior surface of the base unit and the sound tube.

12. An adaptor system as in claim 9 which includes an electronic sound producing module which mechanically engages the base unit with a snap fit.

13. An adaptor system as in claim 9 wherein the sound dampening material reduces acoustic energy from escaping the sound tube along the acoustically sealed path, thereby reducing vibration of the sound tube.

14. An earpiece system for adapting an electronic sound producing module to an elastomeric earpiece device, the earpiece system comprising:

an elastomeric base that mechanically snaps together with the electronic sound producing module, and a vibration dampening sound tube that interfaces with one of a selection of elastomeric devices that fit in the ear or a custom molded in-the-ear housing, wherein the elastomeric base comprises a biocompatible material, wherein the elastomeric base isolates the vibration dampening sound tube from physical contact with a user's ear, permitting the vibration dampening sound tube to comprise a non-biocompatible material, wherein the vibration dampening sound tube is constructed of a sound dampening material that creates an acoustically sealed path for sound traveling therein, wherein at least one of the elastomeric base and the air pressure vent comprises one or more linings of the sound dampening material, and wherein the elastomeric base isolates the sound dampening material from physical contact with the user's ear.

15. An earpiece system as in claim 14 wherein the sound dampening material reduces acoustic energy from escaping the sound tube along the acoustically sealed path, thereby reducing vibration of the sound tube.

16. A custom ear adaptor system used for sound amplification and processing and made to fit in a user's ear, comprising:

a vibration dampening sound tube that provides selected levels of acoustic gain;

an air pressure vent to increase comfort and reduce occlusion;

an expandable balloon that surrounds the vibration dampening sound tube and the air pressure vent; and an elastomeric base unit that carries the vibration dampening tube and the balloon, wherein the balloon, responsive to a shape of a user's ear, provides a human ear fitting that is specific to that user, wherein the balloon is structured to allow the infusion of material into an interior of the balloon, wherein the material solidifies while the balloon is situated in the user's ear, to create a custom fit for the user's ear so that the custom ear adaptor system can be removed and inserted multiple times, wherein the vibration dampening sound tube is constructed of a sound dampening material that creates an acoustically sealed path for sound traveling therein, wherein the balloon comprises a biocompatible material, wherein at least one of the balloon and the air pressure vent comprises one or more linings of the sound dampening material, and wherein the balloon isolates the sound dampening material from physical contact with the user's ear.

17. An adaptor system as in claim 16 wherein the sound dampening material reduces acoustic energy from escaping the sound tube along the acoustically sealed path, thereby reducing vibration of the sound tube.

* * * * *